US006536488B1

(12) United States Patent
Pochobradsky

(10) Patent No.: US 6,536,488 B1
(45) Date of Patent: Mar. 25, 2003

(54) INSERT FOR YARD REFUSE BAG

(76) Inventor: Thomas E. Pochobradsky, 304 30th Street SE., Cedar Rapids, IA (US) 52403

( * ) Notice: Subject to any disclaimer, the term of this patent is extended or adjusted under 35 U.S.C. 154(b) by 0 days.

(21) Appl. No.: 10/119,163

(22) Filed: Apr. 9, 2002

Related U.S. Application Data

(60) Provisional application No. 60/284,119, filed on Apr. 16, 2001.

(51) Int. Cl.[7] ..... B65B 1/04
(52) U.S. Cl. ..... 141/390; 248/95; 248/99
(58) Field of Search ..... 141/390, 313–317, 141/114; 248/99, 95

(56) References Cited

U.S. PATENT DOCUMENTS 4,979,547 A * 12/1990 Hoerner ..... 141/390
5,271,589 A * 12/1993 Belous ..... 248/97
5,897,084 A * 4/1999 Judge ..... 248/95

* cited by examiner

*Primary Examiner*—Steven O. Douglas
(74) *Attorney, Agent, or Firm*—Allan L. Harms

(57) ABSTRACT

An insert for use in filling paper or plastic bags with yard waste materials. An elongate rectangular sleeve of corrugated paper board has an open top and open bottom. Weight retaining elements are formed near the bottom of opposing sidewalls of the insert. Tuck openings are formed along the length of the opposing sidewalls to receive gathered segments of the top edge of a plastic bag in which the insert is placed. Hand openings are formed near the upper ends of opposing sidewalls. The insert may be inverted while a yard waste bag is placed over it and then righted to rest in an upright position with the yard waste bag surrounding it.

19 Claims, 5 Drawing Sheets

INSERT FOR YARD REFUSE BAG

CROSS-REFERENCE TO RELATED APPLICATIONS

This application claims priority from provisional patent application entitled "Insert for Yard Refuse Bag", Ser. No. 60/284,119 filed Apr. 16, 2001. The disclosure of provisional patent application Serial No. 60/284,119 is hereby incorporated in its entirety.

STATEMENT REGARDING FEDERALLY SPONSORED RESEARCH OR DEVELOPMENT

Not Applicable.

BACKGROUND OF THE INVENTION

This invention pertains to a device to assist with filling of kraft paper lawn refuse bags or Al plastic film trash bags. Many municipalities require that lawn or yard waste be bagged in large kraft paper bags for trash pickup. As any lawn care worker knows, when lawn clippings or leaves are to be bagged, the typical paper lawn refuse bag will fall over or tend to collapse as lawn waste is placed in the bag. When flimsy trash bags made from plastic film are filled, the bag openings collapse and the bags are very difficult to fill. The present invention addresses these problems.

BRIEF SUMMARY OF THE INVENTION

An insert for placement in a plastic trash bag or a kraft paper lawn refuse bag retains the bag in a fully open condition while it is being filled. The insert is a rectangular open-ended sleeve which is sized to fit within a lawn refuse bag such as a paper lawn refuse bag commonly used for disposal of grass clippings and leaves. The insert is also sized to fit within the opening of a common thirty to thirty-five gallon size trash bag made of plastic film. Opposing sides of the insert contain one or more retaining elements to hold plastic bags in place. These may be tuck openings which are restricted to retain small gathered segments of the plastic film trash bag. Opposing sides are also equipped at their lower ends with weight receiving slots or compartments. By weighting the insert, the insert and its surrounding paper bag or plastic film bag will resist toppling when placed on uneven ground surfaces or when subject to a breeze. The sleeve may fold to a flat condition for storage or transport. An embodiment of the invention is marketed under the trademark BAG MOUTH™ by Bag-Mouth, Inc. of Cedar Rapids, Iowa.

It is an object of the invention to provide a device to facilitate filling of a yard waste bag of paper or plastic film construction.

It is also an object of the invention to provide a stiffener to hold a yard waste bag in an open mouth condition.

It is a further object of the invention to provide a yard waste bag insert which will resist toppling in mild wind conditions or when the yard waste bag is placed on an uneven ground surface.

It is yet another object of the invention to provide a bag filling insert which can retain the edge of a flimsy trash bag made of plastic film to prevent slumping of the bag while it is being filled.

These and other objects of the invention will become apparent from examination of the description and claims which follow.

BRIEF DESCRIPTION OF THE SEVERAL VIEWS OF THE DRAWING(S)

DETAILED DESCRIPTION OF THE INVENTION

The present invention pertains to handling and filling of discardable bags, particularly bags made of plastic film or paper bags commonly sold and distributed for collection of yard refuse such as grass clippings and leaves. The present invention provides a bag filling insert which fits within a yard refuse bag to support the bag in an upright position while it is being filled with grass clippings, leaves or other yard wastes being collected for disposal. The invention may be used as a bag filling insert to facilitate filling of a household plastic trash bag.

Figure 1:
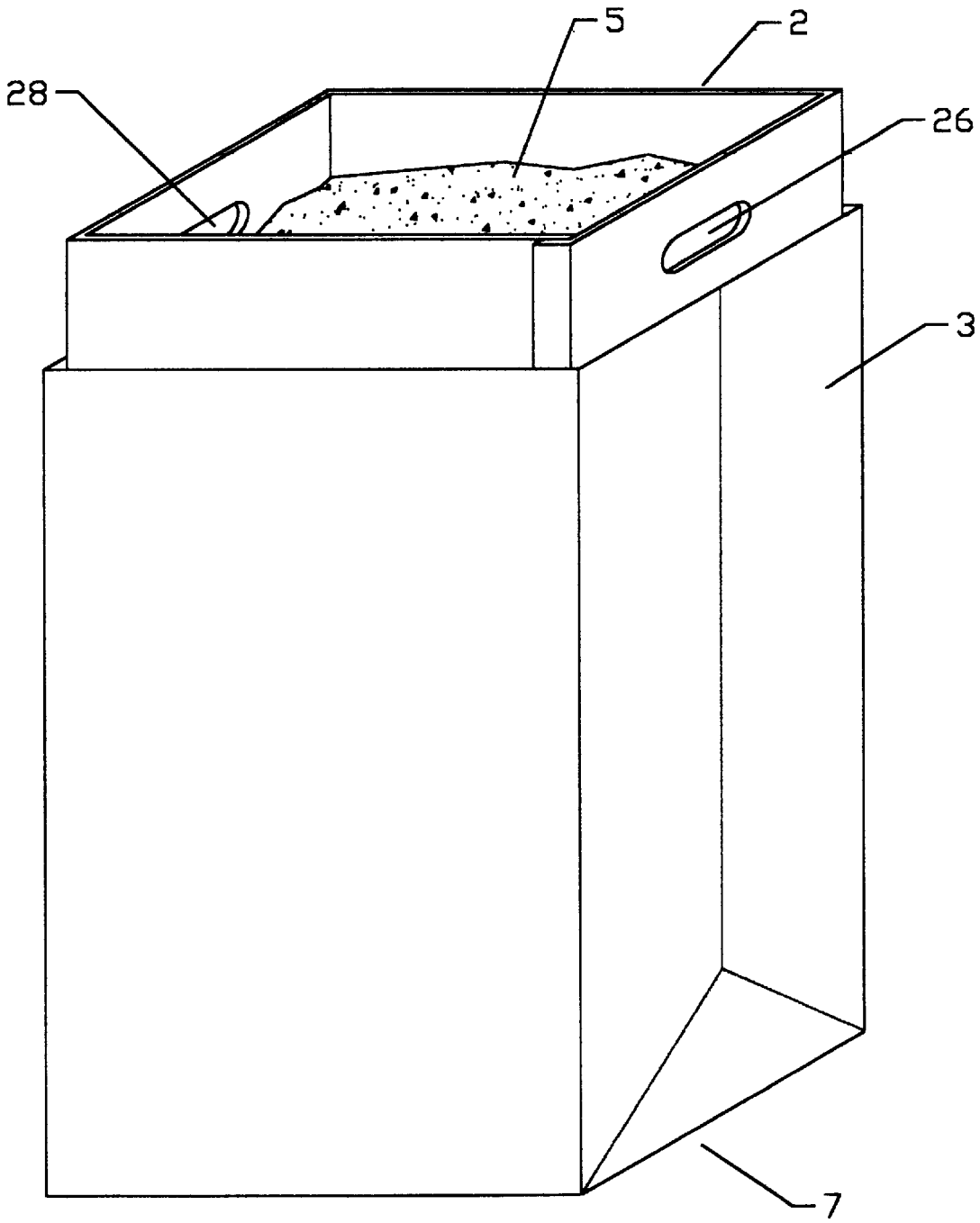
FIG. 1 is a front perspective of the invention inserted into a paper yard refuse bag.

FIG. 1 illustrates the invention insert 2 in use within a paper yard refuse bag 3 oriented in an upright position. Lawn clippings 5 have been placed in the bag by depositing them through open top 4 of insert 2. Because insert 2 is constructed of a stiff material such as cardboard or rigid plastic, preferably corrugated paper board, it will maintain a paper yard refuse bag 3 in an open, upright condition to facilitate filling of the bag 3. Insert 2 may most easily be fitted within bag 3 by inverting invention 2 such that it rests on open top 4 and bag 3 may then be inverted and slid down onto invention 2. Then the bag 3 with insert 2 therein may be righted such that bag 3 rests on its bottom 7 with insert 2 resting within bag 3 on its open lower end 6. Once bag 3 has been filled, insert 2 may be lifted out of bag 3 by raising it by use of hand openings 26, 28 which are die cut or otherwise formed in opposing sidewalls 8, 10 respectively. Lawn clippings 5 fall through open lower end 6 of insert 2 and will remain in bag 3 as insert 2 is raised and removed from bag 3.

Though this description describes corrugated paper board as the preferred material for insert 2, thin-walled rigid plastic may also be used, along with other generally lightweight materials.

Figure 5:
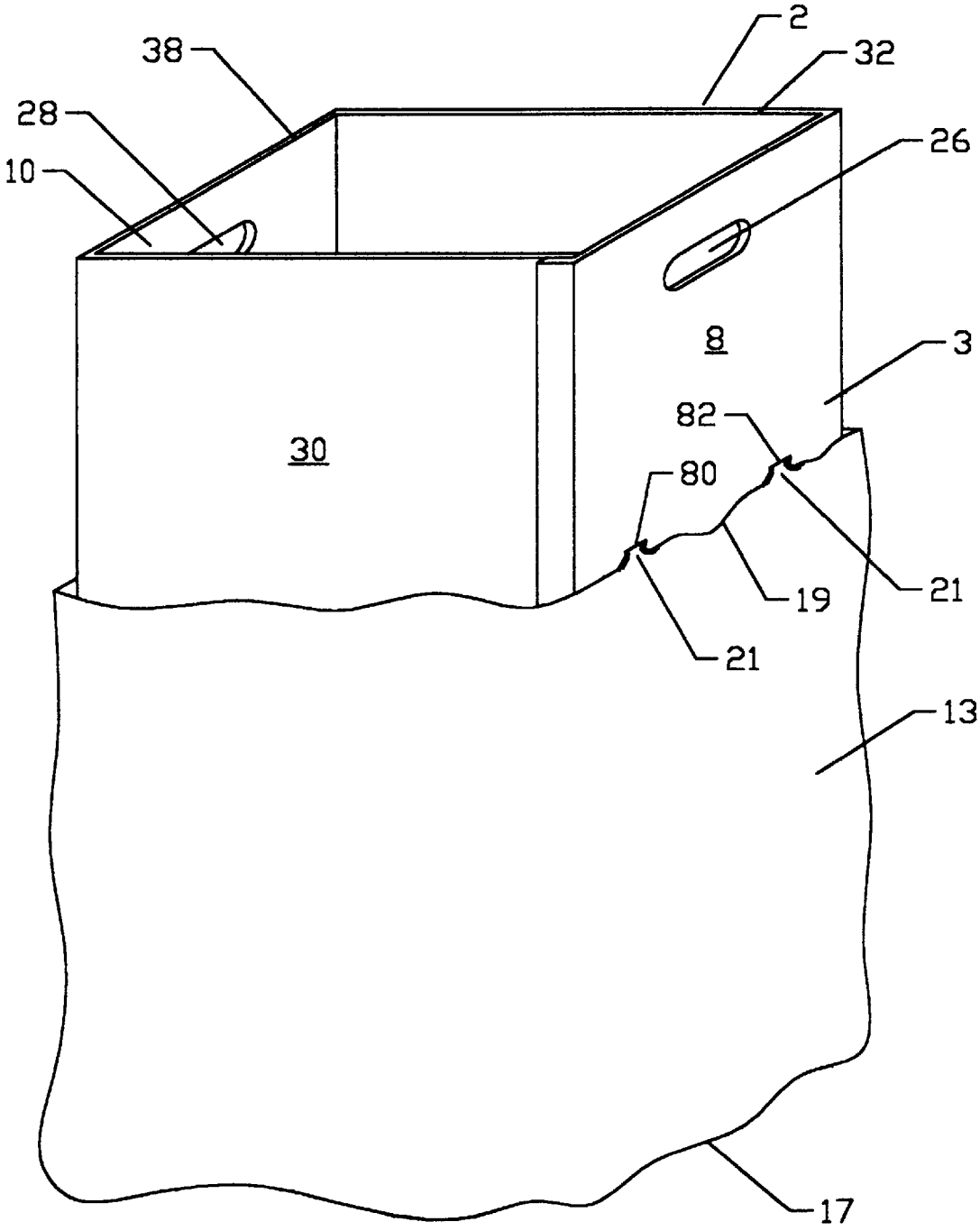
FIG. 5 is a front perspective of the invention inserted into a plastic trash bag with portions of the sidewall of the bag inserted in retention holes in opposing sidewalls of the invention.

FIG. 5 illustrates the preferred embodiment insert 2 inserted within a common household trash bag 13 which is constructed of plastic film. To facilitate placement of insert 2 into trash bag 13, insert 2 may be inverted as described in connection with FIG. 1 and placed to rest on its top end 38. Trash bag 13 may be opened and slid downward to cover the lower end 6 of insert 2 and extend along its walls 8, 10, 30, 32. Short segments 21 of the upper edge 19 of trash bag 13 may be gathered and inserted into tuck openings 80, 82 formed on sidewall 8 and in opposing identical tuck openings (not shown in FIG. 5) on opposing sidewall 10. Tuck openings 80, 82 serve as retaining elements to retain the segments 21 to the insert 2. Alternate structures such as clips, hooks, or adhesives could be used in place of tuck openings 80, 82 to grasp segments 21 or other portions of the sidewall of bag 13. After the trash bag 13 is placed over insert 2, the insert 2 may then be turned upright to rest on bottom 17 of trash bag 13 with lower end 6 of insert therein. Trash bag 13 may then be filled as desired with lawn waste or other refuse, or any other material desired to be placed in trash bag 13. Segments 21 of top edge 19 of trash bag 13 may be removed from the tuck holes 80, 82 and insert 2 may be lifted out of filled trash bag 13. It will be easily understood that insert 2 provides a rigid structure for trash bag 13 to keep it fully open and upright while it is being filled.

Figure 2:
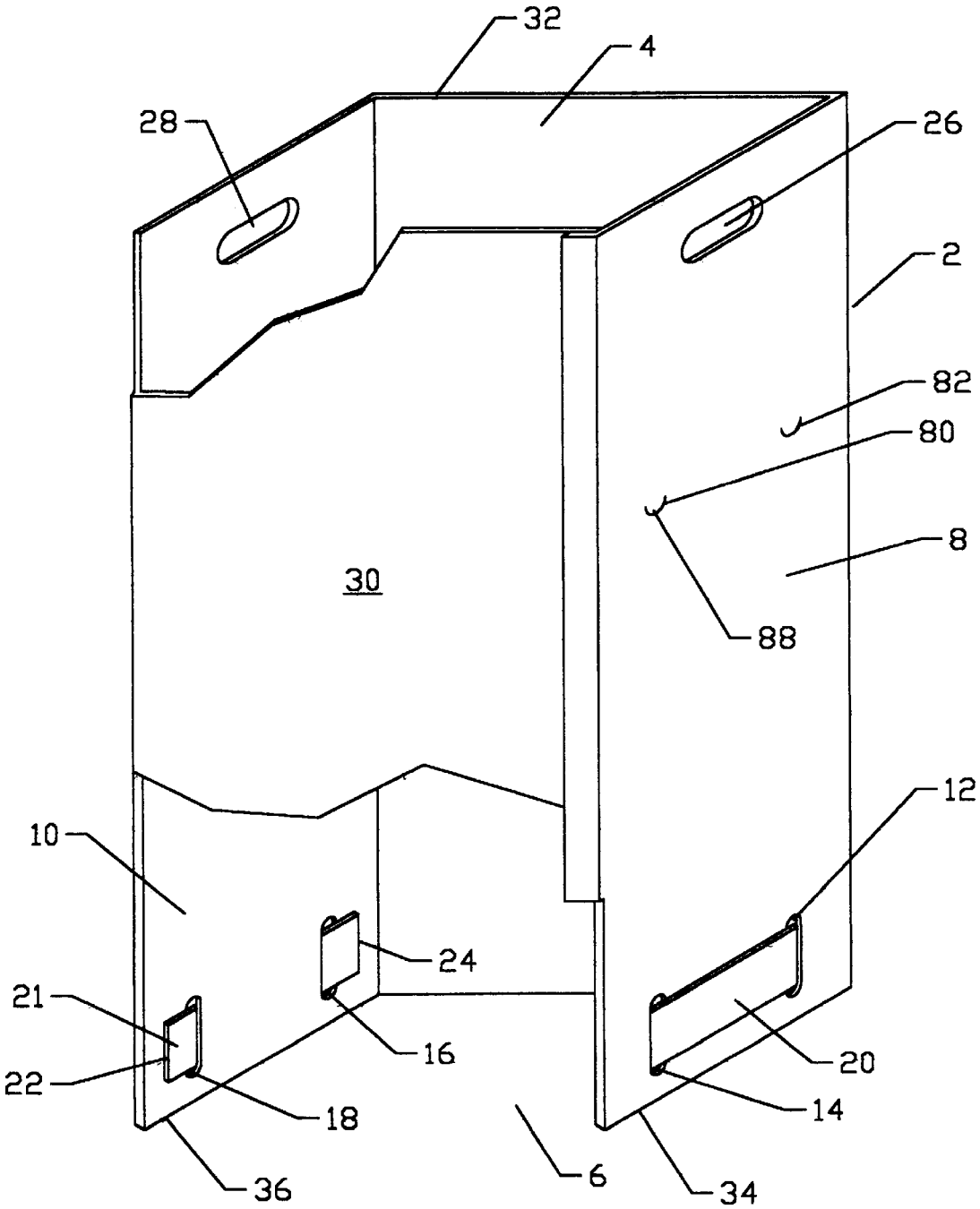
FIG. 2 is a front perspective of the preferred embodiment of the invention with portions of the front wall cut away and with weights installed in opposing sidewalls of the invention.

Referring to FIG. 2, insert 2 may be seen with part of its front wall 30 cut away. Insert 2 preferably comprises an open rectangular sleeve having a front wall 30, opposing rear wall 32 and opposing sidewalls 8, 10 which interconnect front wall 30 and rear wall 32. Insert 2 is provided with an open top 4 and open bottom 6. Hand openings 26, 28 are located near the tops of sidewalls 8, 10 respectively. Spaced apart but near lower edges 34, 36 of sidewalls 8, 10 respectively are slots 12, 14 and 16, 18. Slots 12, 14 and 16, 18 are paired, each pair being spaced apart laterally. Slots 12, 14 and 16, 18 penetrate sidewalls 8, 10 respectively and may be die cut or formed. An elongate weight 20 may be secured to sidewall 8 in a simple tensioned manner by sliding it through first slot 14 from inside to outside and then through slot 16 from outside to inside. Similarly, elongate weight 21 may be secured to sidewall 10 by sliding it through paired slots 16, 18 such that opposing ends 22, 24 of weight 21 extend outwardly from slots 16, 18. Preferably weights 20 and 21 are of dense metal such as steel and are elongate plates or bars of approximately one to five pounds each which will fit in paired slots 12, 14 and 16, 18 and tension the area of sidewalls 8, 10 between paired slots 12, 14 and 16, 18 to thereby resist removal from sidewalls 8, 10.

Figure 3:
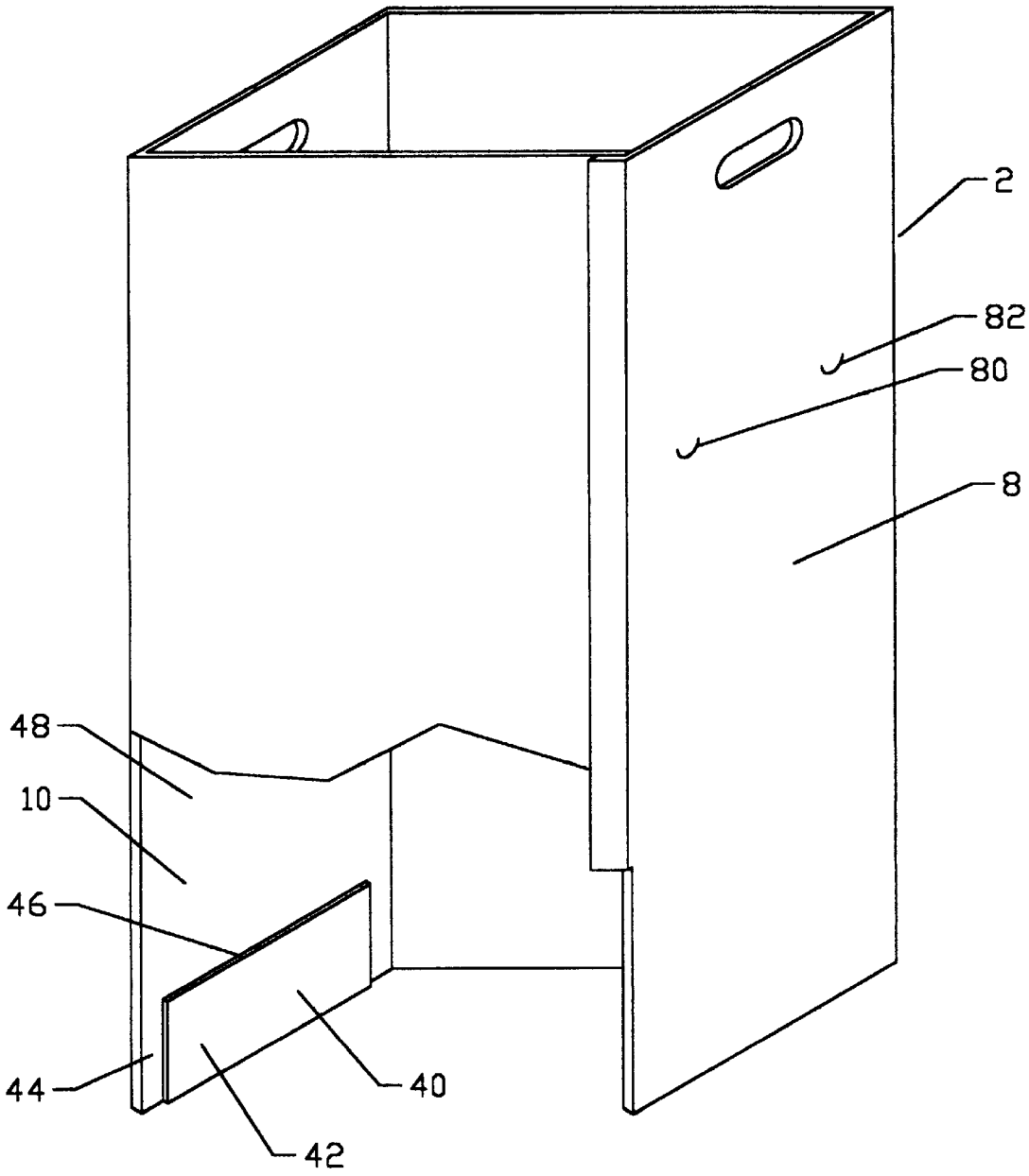
FIG. 3 is a front perspective of an alternate embodiment of the invention with a part of the front wall thereof cut away.

Referring to FIG. 3, weights 20, 21 may be secured by other means to sidewalls 8, 10, such as by adhesives or by placing weights 20, 21 in a pocket 40 created by folding an elongation 42 of each of sidewalls 8, Cover upon the sidewall, as may be seen at lower section 44 of sidewall 10. Elongation 42 may be secured at its terminal edge 46 to inner face 48 of sidewall 10 by adhesives or stapling or other mechanical attachment.

Figure 4:
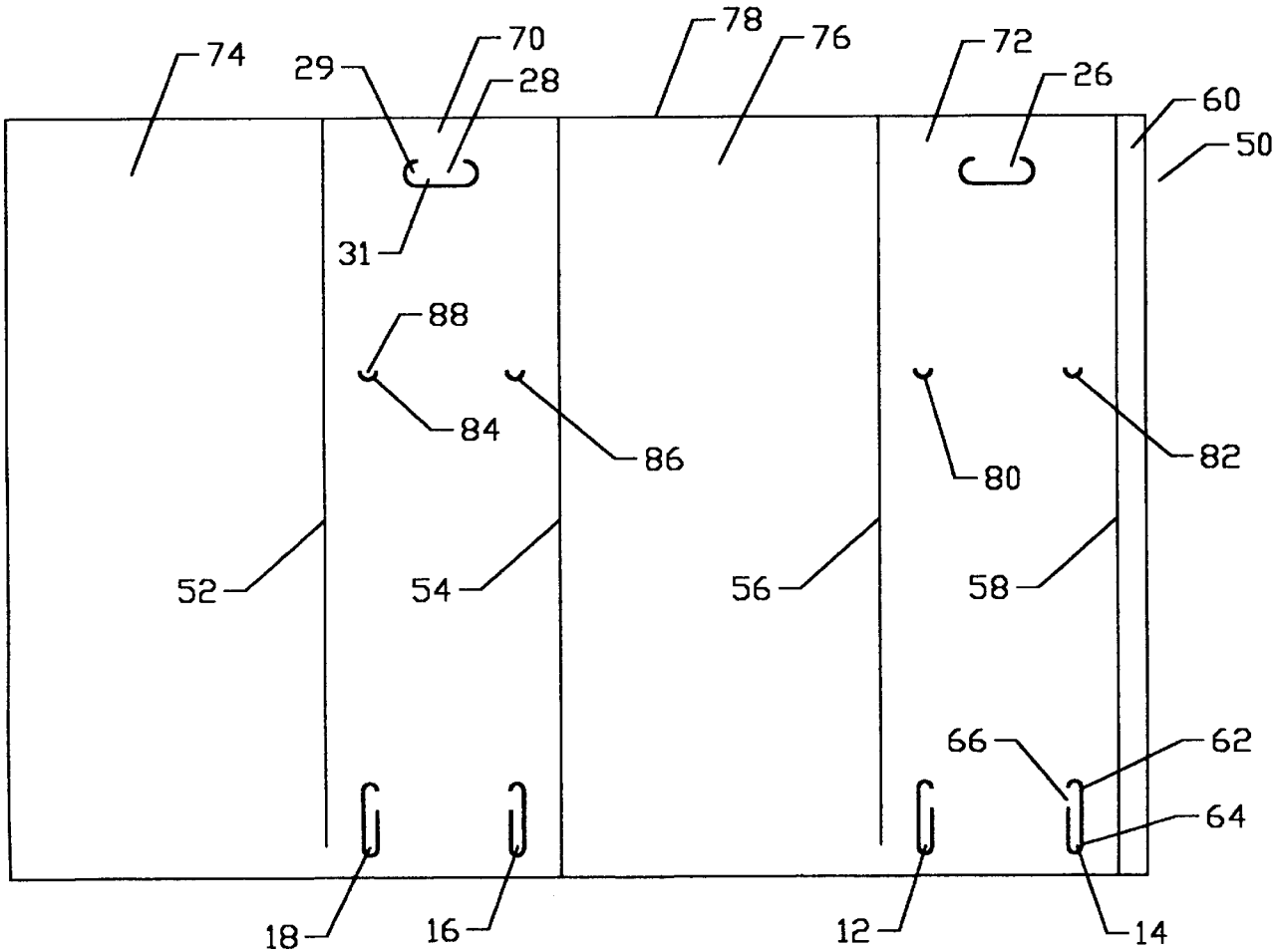
FIG. 4 is a front elevation of a blank which may be used to form the preferred embodiment of the invention.

Referring to both FIGS. 2 and 3, each of sidewalls 8 and 10 is provided with one or more (preferably two) tuck openings 80, 82 and 84, 86 (See FIG. 4). Tuck openings 80, 82 are formed approximately two feet from bottom 6 of insert 2 such that the top edge of a common plastic film trash bag of capacity of thirty to thirty-five gallons will extend to the height of tuck openings 80, 82 and so that short segments of the top edge of the bag may be gathered and inserted into tuck openings 80, 82 and 84, 86. Tuck openings 80, 82 may be half circle die cuts through the sidewalls 8 such that a flap 88 is formed for each tuck opening 80, 82, 84, 86. When segments of the sidewall of a plastic bag are gathered and inserted into tuck openings 80, 82, 84, 86, friction created by flaps 88 will resist the segments slipping out of the tuck openings 80, 82, 84, 86.

FIG. 4 illustrates a blank 50 of corrugated paper board which may be formed into the preferred embodiment of insert 2 shown in FIG. 2. Blank 50 is provided with first crease 52 which provides a fold line which separates first panel 74 from second panel 70. Second crease 54 provides a fold line which separates second panel 70 from third panel 76 and third crease 56 provides a fold line which separates fourth panel 72 from third panel 76. An over flap 60 is formed when blank 50 is folded at a perpendicular about fourth crease 58. Over flap 60 may overlap a small segment of the outside of first panel 74 when insert 2 is created by folding blank 50 about creases 52, 54, 56 and 58. Over flap 60 may be adhered to first panel 74 by adhesive, stapling, sonic welding or the like. It is intended that a rectangular sleeve be formed from blank 50, panels 72, 70 becoming sidewalls 8, 10 respectively and being essentially the same in lateral width while third panel 76 becomes front wall 30 and first panel 74 becomes rear wall 37, with panels 74, 76 being essentially the same width. Over flap 60 need only be one to three inches in width but it preferably extends the full length of blank 50. Preferably blank 50 is thirty-six inches long and about fifty-four inches wide. Because sleeve 2 may be made from corrugated paper board, it may be folded flat for storage or transport.

Each of second panel 70 and fourth panel 72 (which become the sidewalls 10, 8 respectively) includes paired tuck openings 84, 86 and 80, 82 respectively. In the preferred embodiment, two tuck openings are used on opposing sidewalls. However, tuck openings could alternatively be die cut into panels 74, and 76, or each of panels 70, 72, 74, and 76 could be provided with tuck openings or other bag retention elements.

Each tuck opening 80, 82, 84, 86 is formed preferably by making a semicircular die cut through the blank 50. This results in half circle shaped flaps 88 attached to the blank 50. Because corrugated paper board is the preferred material for construction of insert 2, the flaps 88 can be easily bent about their attachments to blank 50 by finger pressure pushing a segment of a plastic bag wall through tuck openings 80, 82, 84, 86. The flaps 88 will tend to return to their original position in planar alignment with the sidewall in which they are formed and will snag the segment of the plastic trash bag and prevent the plastic trash bag from slumping about the insert 2.

If insert 2 is constructed of rigid or semi-rigid plastic, tuck openings 80, 82, 84, 86 may be formed as crescents or other constricted openings such that plastic bag edge segments will snag within the openings.

Each slot 12, 14, 16, 18 of blank 50 is formed by a die cut which makes an incomplete oval or round cornered rectangle while narrow nicks 62, 64 and bend region 66 of each of slots 12, 14, 16, 18 are left uncut. Nicks 62, 64 assist with keeping tabs 68 of slots 12, 14, 16, 18 aligned with walls 8, 10 until a weight is to be slid through them. Bend regions 66 provide attachment to sidewalls 8, 10 so that tabs 68 do not separate from sidewalls 8, 10 when weights are passed through slots 12, 14 and 16, 18, thereby providing additional frictional resistance to resist slippage of weights 20 within slots 12, 14 and 16, 18 during handling of the assembled insert 2.

Hand openings 26, 28 are die cut in panels 70, 72 near leading edge 78 of blank 50. Flaps 29 of each of hand openings 26, 28 permit fold outs 31 of each thereof to be folded inwardly to create a grip cushion and provide additional rigidity to hand openings 26, 28.

Having described the invention, I claim:

1. An insert for use to fill a bag formed of plastic film comprises an elongate sleeve having open opposing ends and a sidewall, the ends comprising a top end and a bottom end, the sleeve at least of length greater than the length of the bag, the sleeve receivable within the bag, at least one bag retaining element disposed on the sidewall along the length thereof the at least one bag retaining element disposed to receive a segment of the bag for retention to the sleeve, the sleeve comprises a weight receiving element thereon, the weight receiving element disposed near the bottom end of the sleeve.

2. The insert of claim 1 wherein a metal weight is received in each weight receiving element.

3. A device for use to facilitate manual filling of a yard waste bag comprises an elongate sleeve having open opposing ends and a sidewall, the ends comprising a top end and a bottom end, the sleeve at least of length generally equal to the length of the bag, the sleeve receivable within the bag, the sidewall comprising at least one weight retaining element adjacent the bottom end thereof.

4. The device of claim 3 wherein the at least one weight retaining element comprises a pair of spaced apart vertical slots.

5. The device of claim 3 wherein the at least one weight retaining element comprises a compartment fixed to the sidewall, the compartment comprising an elongated portion of the sidewall folded over upon itself.

6. The device of claim 3 wherein a hand grip element is disposed in the sidewall near the top end of the sleeve, the hand grip element comprising an elongate generally horizontal opening in the sidewall, the hand grip element comprising a top edge having a cushion thereon.

7. The device of claim 3 wherein the sleeve comprises four sidewalls joined together, a hand grip is fixed to each of opposing ones of the sidewalls adjacent the top end of the sleeve.

8. The device of claim 7 wherein at least one bag retaining element is fixed to each of opposing ones of the sidewalls along the lengths thereof.

9. The device of claim 8 wherein the at least one bag retaining element of each of the opposing sidewalls comprises a constricted opening through the sidewall.

10. The device of claim 9 wherein the hand grip of each of the opposing ones of the sidewalls comprises an elongate generally horizontal opening in the sidewall, each hand grip comprising a top edge having a cushion thereon.

11. The device of claim 7 wherein a weight retaining element is disposed on each of opposing ones of the sidewalls, each weight retaining element disposed near the bottom end of the sleeve.

12. The device of claim 11 wherein each weight retaining element comprises a pair of spaced apart substantially non-horizontal slots.

13. The device of claim 12 wherein an elongate metal plate is disposed within each pair of spaced apart vertical slots.

14. An insert for use to fill a bag formed of plastic film comprises an elongate sleeve having open opposing ends and a sidewall, the ends comprising a top end and a bottom end, the sleeve at least of length greater than the length of the bag, the sleeve receivable within the bag, at least one bag retaining element disposed on the sidewall along the length thereof the at least one bag retaining element disposed to receive a segment of the bag for retention thereof to the sleeve, the at least one bag retaining element comprising a die cut in the sidewall defining a deflectable flap, whereby the segment of the bag may be frictionally retained by the flap.

15. The insert of claim 14 wherein the sleeve is constructed of corrugated paper board, the sleeve comprising four walls joined together in a rectangular shape, the sleeve may be folded to a substantially flat condition for storage, each of opposing ones of the sidewalls includes at least one bag retaining element disposed therealong, each bag retaining element comprising an opening through the sidewall and a deflectable flap, whereby a gathered segment of the bag may be retained by one or more of the bag retaining elements.

16. The insert of claim 14 wherein each of an opposing pair of walls of the sleeve comprise hand grip openings therein, each hand grip opening disposed near the top end of the sleeve.

17. The insert of claim 14 wherein the die cut is curvilinear and defines a flap having a curved free edge.

18. The claim 17 wherein the die cut is semicircular.

19. The insert of claim 14 wherein the die cut defines a crescent-shaped opening through the sidewall.

* * * * *